US010896604B2

(12) United States Patent
Du et al.

(10) Patent No.: US 10,896,604 B2
(45) Date of Patent: Jan. 19, 2021

(54) SYSTEMS AND METHODS FOR DETERMINING TRAFFIC INFORMATION OF A REGION

(71) Applicant: BEIJING DIDI INFINITY TECHNOLOGY AND DEVELOPMENT CO., LTD., Beijing (CN)

(72) Inventors: Zelong Du, Beijing (CN); Weili Sun, Beijing (CN); Jinqing Zhu, Beijing (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/905,949

(22) Filed: Jun. 19, 2020

(65) Prior Publication Data

US 2020/0320873 A1 Oct. 8, 2020

Related U.S. Application Data

(63) Continuation of application No. PCT/CN2018/122125, filed on Dec. 19, 2018.

(30) Foreign Application Priority Data

Nov. 28, 2018 (CN) ..... 2018 1 1435943

(51) Int. Cl.
*G08G 1/08* (2006.01)
*G08G 1/01* (2006.01)
*G08G 1/0967* (2006.01)

(52) U.S. Cl.
CPC ..... *G08G 1/08* (2013.01); *G08G 1/0141* (2013.01); *G08G 1/0145* (2013.01); *G08G 1/096775* (2013.01)

(58) Field of Classification Search
CPC ..... G08G 1/08; G08G 1/0145; G08G 1/0141; G08G 1/096775
See application file for complete search history.

(56) References Cited

U.S. PATENT DOCUMENTS

2019/0114909 A1* 4/2019 Halama ..... G08G 1/096716
2020/0143672 A1* 5/2020 Ashida ..... G08G 1/0141
2020/0249048 A1 8/2020 Qi et al.

FOREIGN PATENT DOCUMENTS

CN 101086804 A 12/2007
CN 101894477 A 11/2010
(Continued)

OTHER PUBLICATIONS

International Search Report in PCT/CN2018/122125 dated Aug. 29, 2019, 5 pages.

(Continued)

*Primary Examiner* — Peter D Nolan
*Assistant Examiner* — Ashley L Redhead, Jr.
(74) *Attorney, Agent, or Firm* — Metis IP LLC

(57) ABSTRACT

The present disclosure relates to systems and methods for determining traffic information of a region. The method may include determining a first region and a second region. The method may also include obtaining a set of links associated with the first region and the second region. The method may also include obtaining a plurality of driving routes of a plurality of vehicles in the first region and the second region in a predetermined time period. The method may also include selecting one or more driving routes that traverse a first boundary of the first region and a second boundary of the second region based on the set of links associated with the first region and the second region. The method may also include determining traffic information of the first region based on information related to the one or more selected driving routes.

15 Claims, 9 Drawing Sheets

(56) References Cited

FOREIGN PATENT DOCUMENTS

| | | | |
|---|---|---|---|
| CN | 102881173 | A | 1/2013 |
| CN | 103000027 | A | 3/2013 |
| CN | 105608894 | A | 5/2016 |
| CN | 106960582 | A | 7/2017 |
| JP | H1153687 | A | 2/1999 |
| JP | 2016133876 | A | 7/2016 |

OTHER PUBLICATIONS

Written Opinion in PCT/CN2018/122125 dated Aug. 29, 2019, 4 pages.
Song Chen, Research on Traffic Demand Control Using the Two-Fluid Theory for the Sensitive Areas of Urban Networks, 2011, 65 pages.
First Office Action in Chinese Application No. 201811435943.1 dated Oct. 19, 2020, 11 pages.

* cited by examiner

SYSTEMS AND METHODS FOR DETERMINING TRAFFIC INFORMATION OF A REGION

CROSS-REFERENCE TO RELATED APPLICATIONS

This application is a Continuation of International Application No. PCT/CN2018/122125 filed on Dec. 19, 2018, which claims priority to Chinese Application No. 201811435943.1 filed on Nov. 28, 2018, the contents of each of which are incorporated herein by reference in their entirety.

TECHNICAL FIELD

The present disclosure generally relates to systems and methods for determining traffic information of a region, and in particular, to systems and methods for determining traffic information by analyzing traffic flow in and out of subregions of a region.

BACKGROUND

During rush hours (e.g., 7 a.m.-9 a.m., 5 p.m.-7 p.m.), an increasing number of vehicles may enter or leave a same region (e.g., Zhongguancun Science and Technology Park in Beijing), thereby causing some roads associated with the region to congest. Current navigation apps implemented on the smart phones can receive real-time traffic information and display the traffic information on a user interface, thus alert the driver of any road congestions. For example, the congested roads may be marked in a navigation map or an electric map with a red color, the non-congested roads may be marked with a green color, and a traffic condition between congested and non-congested may be marked with an orange color. Thus, the drivers may choose to detour the congested roads based on the marked map. However, merely depending on the drivers' action is not efficient enough to alleviate the congestion of the roads. Therefore, it is desirable to provide systems and methods for determining traffic information of a region to perform traffic control efficiently.

SUMMARY

In one aspect of the present disclosure, a system for determining traffic information of a region is provided. The system may include at least one storage medium and at least one processor in communication with the at least one storage medium. The at least one storage medium may include a set of instructions. When executing the set of instructions, the at least one processor may be directed to: determine a first region and a second region, the first region being within the second region; obtain a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region; obtain a plurality of driving routes of a plurality of vehicles in the first region and the second region in a predetermined time period; select one or more driving routes that traverse the first boundary and the second boundary based on the set of links associated with the first region and the second region; and determine traffic information of the first region based on information related to the one or more selected driving routes, the traffic information including at least one of first traffic information indicating traffic flowing into the first region from the second region or second traffic information indicating traffic flowing out of the first region to the second region.

In some embodiments, wherein to determine the traffic information of the first region based on information related to the one or more selected driving routes, the at least one processor may be directed to cause the system further to: for each of the one or more driving routes that traverse the first boundary and the second boundary, determine a first link cross the first boundary; and determine a second link cross the second boundary; and determine the traffic information based on information related to one or more target routes from the first links to the second links, wherein each of the one or more target routes may be a portion of a corresponding driving route that traverses the first boundary and the second boundary.

In some embodiments, links between the first link and the second link of the each of the one or more target routes may be within the second region other than the first region.

In some embodiments, wherein to determine the second region, the at least one processor may be directed to cause the system to: determine a plurality of target links, wherein the plurality of target links may form the second boundary of the second region; and determine the second region based on the plurality of target links.

In some embodiments, wherein to determine the first traffic information indicating traffic flowing into the first region from the second region, the at least one processor may be directed to cause the system to: determine a first location that the second link intersects with the second boundary; determine a second location that the first link intersects with the first boundary; determine a first average speed of vehicles traveling from the first location to the second location with respect to each of the plurality of target links; for each of the plurality of target links, determine a first count of vehicles entering the first region from each of the plurality of target links; and determine a first ratio associated with each of the plurality of target links based on the first count of vehicles and a total counts of vehicles entering the first region from the plurality of target links; and determine the first traffic information based on at least one of the first average speeds, the first counts of vehicles, or the first ratios.

In some embodiments, wherein to determine the second traffic information indicating traffic flowing out of the first region to the second region, the at least one processor may be directed to cause the system to: determine a third location that the first link intersects with the first boundary; determine a fourth location that the second link intersects with the second boundary; determine a second average speed of vehicles traveling from the third location to the fourth location with respect to each of the plurality of target links; for each of the plurality of target links, determine a second count of vehicles leaving the first region via each of the plurality of target links; and determine a second ratio associated with each of the plurality of target links based on the second count of vehicles leaving the first region and a total count of vehicles leaving the first region via the plurality of target links; and determine the second traffic information based on at least one of the second average speeds, the second counts of vehicles, or the second ratios.

In some embodiments, wherein the at least one processor may be configured further to: determine at least one congested driving route based on the traffic information of the first region.

In some embodiments, the at least one processor may be configured further to: transmit the traffic information associated with the first region and the second region to a third-party causing the third-party to adjust traffic lights control of at least the first region or the second region based on the traffic information associated with the first region and the second region.

In some embodiments, wherein the at least one processor may be configured further to: transmit the traffic information associated with the first region and the second region to a third-party causing the third-party to perform traffic control on at least the first region or the second region.

In another aspect of the present disclosure, a method for determining a target position of a target subject is provided. The method may be implemented on a computing device having at least one processor, at least one storage medium, and a communication platform connected to a network. The method may include determining a first region and a second region, the first region being within the second region; obtaining a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region; obtaining a plurality of driving routes of a plurality of vehicles in the first region and the second region in a predetermined time period; selecting one or more driving routes that traverse the first boundary and the second boundary based on the set of links associated with the first region and the second region; and determining traffic information of the first region based on information related to the one or more selected driving routes, the traffic information including at least one of first traffic information indicating traffic flowing into the first region from the second region or second traffic information indicating traffic flowing out of the first region to the second region.

In some embodiments, wherein the determining the traffic information of the first region based on information related to the one or more selected driving routes may include: for each of the one or more driving routes that traverse the first boundary and the second boundary, determining a first link cross the first boundary; and determining a second link cross the second boundary; and determining the traffic information based on information related to one or more target routes from the first links to the second links, wherein each of the one or more target routes may be a portion of a corresponding driving route that traverses the first boundary and the second boundary.

In some embodiments, wherein links between the first link and the second link of the each of the one or more target routes may be within the second region other than the first region.

In some embodiments, wherein the determining the second region may include: determining a plurality of target links, wherein the plurality of target links may form the second boundary of the second region; and determining the second region based on the plurality of target links.

In some embodiments, wherein the determining the first traffic information indicating traffic flowing into the first region from the second region may include: determining a first location that the second link intersects with the second boundary; determining a second location that the first link intersects with the first boundary; determine a first average speed of vehicles traveling from the first location to the second location with respect to each of the plurality of target links; for each of the plurality of target links, determine a first count of vehicles entering the first region from each of the plurality of target links; and determine a first ratio associated with each of the plurality of target links based on the first count of vehicles and a total counts of vehicles entering the first region from the plurality of target links; and determine the first traffic information based on at least one of the first average speeds, the first counts of vehicles, or the first ratios.

In some embodiments, wherein the determining the second traffic information indicating traffic flowing out of the first region to the second region may include: determining a third location that the first link intersects with the first boundary; determining a fourth location that the second link intersects with the second boundary; determining a second average speed of vehicles traveling from the third location to the fourth location with respect to each of the plurality of target links; for each of the plurality of target links, determining a second count of vehicles leaving the first region via each of the plurality of target links; and determining a second ratio based on the second count of vehicles leaving the first region and a total count of vehicles leaving the first region via each of the plurality of target links; and determining the second traffic information based on at least one of the second average speeds, the second counts of vehicles, or the second ratios.

In some embodiments, the method may also include determining at least one congested driving route based on the traffic information of the first region.

In some embodiments, the method may also include transmitting the traffic information associated with the first region and the second region to a third-party causing the third-party to adjust traffic lights control of at least the first region or the second region based on the traffic information associated with the first region and the second region.

In some embodiments, the method may also include transmitting the traffic information associated with the first region and the second region to a third-party causing the third-party to perform traffic control on at least the first region or the second region.

In another aspect of the present disclosure, a non-transitory computer readable medium for determining a target position of a target subject is provided. The non-transitory computer readable medium, including executable instructions that, when executed by at least one processor, may direct the at least one processor to perform a method. The method may include determining a first region and a second region, the first region being within the second region; obtaining a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region; obtaining a plurality of driving routes of a plurality of vehicles in the first region and the second region in a predetermined time period; selecting one or more driving routes that traverse the first boundary and the second boundary based on the set of links associated with the first region and the second region; and determining traffic information of the first region based on information related to the one or more selected driving routes, the traffic information including at least one of first traffic information indicating traffic flowing into the first region from the second region or second traffic information indicating traffic flowing out of the first region to the second region.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities, and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
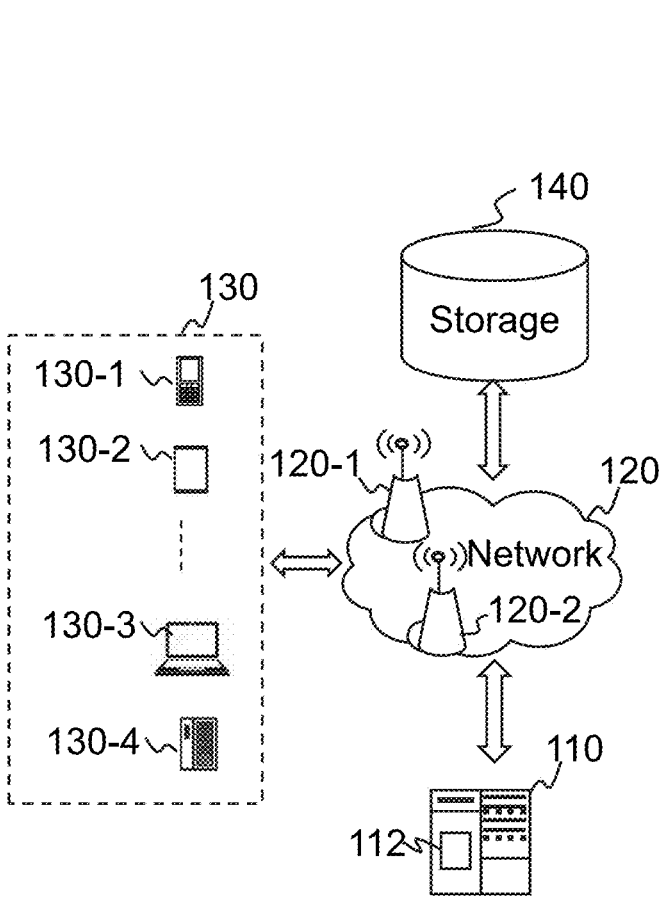
FIG. 1 is a schematic diagram illustrating an exemplary traffic monitoring system according to some embodiments of the present disclosure.

The following description is presented to enable any person skilled in the art to make and use the present disclosure and is provided in the context of a particular application and its requirements. Various modifications to the disclosed embodiments will be readily apparent to those skilled in the art, and the general principles defined herein may be applied to other embodiments and applications without departing from the spirit and scope of the present disclosure. Thus, the present disclosure is not limited to some embodiments shown but is to be accorded the widest scope consistent with the claims.

The terminology used herein is for the purpose of describing particular example embodiments only and is not intended to be limiting. As used herein, the singular forms "a," "an," and "the" may be intended to include the plural forms as well, unless the context clearly indicates otherwise. It will be further understood that the terms "comprise," "comprises," and/or "comprising," "include," "includes," and/or "including," when used in this specification, specify the presence of stated features, integers, steps, operations, elements, and/or components, but do not preclude the presence or addition of one or more other features, integers, steps, operations, elements, components, and/or groups thereof.

These and other features, and characteristics of the present disclosure, as well as the methods of operation and functions of the related elements of structure and the combination of parts and economies of manufacture, may become more apparent upon consideration of the following description with reference to the accompanying drawings, all of which form a part of this disclosure. It is to be expressly understood, however, that the drawings are for the purpose of illustration and description only and are not intended to limit the scope of the present disclosure. It is understood that the drawings are not to scale.

The flowcharts used in the present disclosure illustrate operations that systems implement according to some embodiments of the present disclosure. It is to be expressly understood, the operations of the flowchart may be implemented not in order. Conversely, the operations may be implemented in inverted order, or simultaneously. Moreover, one or more other operations may be added to the flowcharts. One or more operations may be removed from the flowcharts.

Moreover, while the systems and methods disclosed in the present disclosure are described primarily regarding determining traffic information of a region, it should also be understood that this is only one exemplary embodiment. The systems and methods of the present disclosure may be applied to transportation systems of different environments, e.g., land, ocean, aerospace, or the like, or any combination thereof. The vehicle of the transportation systems may include a taxi, a private car, a hitch, a bus, a train, a bullet train, a high-speed rail, a subway, a vessel, an aircraft, a spaceship, a hot-air balloon, a driverless vehicle, or the like, or any combination thereof. The application of the systems and methods of the present disclosure may also include a webpage, a plug-in of a browser, a client terminal, a custom system, an internal analysis system, an artificial intelligence robot, or the like, or any combination thereof.

The positioning technology used in the present disclosure may be based on a global positioning system (GPS), a global navigation satellite system (GLONASS), a compass navigation system (COMPASS), a Galileo positioning system, a quasi-zenith satellite system (QZSS), a wireless fidelity (WiFi) positioning technology, or the like, or any combination thereof. One or more of the above positioning systems may be used interchangeably in the present disclosure.

An aspect of the present disclosure relates to systems and methods for determining traffic information of a region. The system may obtain a set of links associated with a first region and a second region. The first region may be within the second region. The system may also obtain a plurality of driving routes of a plurality of vehicles in the first region and the second region in a predetermined time period. The driving routes may be divided into one or more links according to the set of links. The system may further select one or more driving routes that include a first link traversing a first boundary of the first region and a second link traversing a second boundary of the second region from the plurality of driving routes. The system may further determine at least one of first traffic information indicating traffic flowing into the first region from the second region or second traffic information indicating flowing out of the first region to the second region. Further, the system may transmit the traffic information to a third party (e.g., a traffic control department), and the third party may perform traffic control on the first region or the second region.

FIG. 1 is a schematic diagram illustrating an exemplary traffic monitoring system according to some embodiments of the present disclosure. The traffic monitoring system 100 may include a server 110, a network 120, a user terminal 130, and a storage 140.

In some embodiments, the server 110 may be a single server or a server group. The server group may be centralized, or distributed (e.g., the server 110 may be a distributed system). In some embodiments, the server 110 may be local or remote. For example, the server 110 may access information and/or data stored in the user terminal 130, and/or the storage 140 via the network 120. As another example, the server 110 may be directly connected to the user terminal 130, and/or the storage 140 to access stored information and/or data. In some embodiments, the server 110 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof. In some embodiments, the server 110 may be implemented on a computing device 200 having one or more components illustrated in FIG. 2.

In some embodiments, the server 110 may include a processing engine 112. For example, the processing engine 112 may determine at least one of first traffic information indicating traffic flows into a first region from a second region, or second traffic information indicating traffic flows out of the first region to the second region. The first region may be inside the second region. In some embodiments, the processing engine 112 may include one or more processing engines (e.g., single-core processing engine(s) or multi-core processor(s)). The processing engine 112 may include a central processing unit (CPU), an application-specific integrated circuit (ASIC), an application-specific instruction-set processor (ASIP), a graphics processing unit (GPU), a physics processing unit (PPU), a digital signal processor (DSP), a field programmable gate array (FPGA), a programmable logic device (PLD), a controller, a microcontroller unit, a reduced instruction-set computer (RISC), a microprocessor, or the like, or any combination thereof.

The network 120 may facilitate exchange of information and/or data. In some embodiments, one or more components of the traffic monitoring system 100 (e.g., the server 110, the user terminal 130, or the storage 140) may transmit information and/or data to another component(s) of the traffic monitoring system 100 via the network 120. For example, the server 110 may obtain driving routes from a plurality of user terminals 130 via the network 120. In some embodiments, the network 120 may be any type of wired or wireless network, or any combination thereof. Merely by way of example, the network 120 may include a cable network, a wireline network, an optical fiber network, a telecommunications network, an intranet, an Internet, a local area network (LAN), a wide area network (WAN), a wireless local area network (WLAN), a metropolitan area network (MAN), a public telephone switched network (PSTN), a Bluetooth network, a ZigBee network, a near field communication (NFC) network, or the like, or any combination thereof. In some embodiments, the network 120 may include one or more network access points. For example, the network 120 may include wired or wireless network access points such as base stations and/or internet exchange points 120-1, 120-2, . . . , through which one or more components of the traffic monitoring system 100 may be connected to the network 120 to exchange data and/or information.

In some embodiments, the user terminal 130 may include a mobile device 130-1, a tablet computer 130-2, a laptop computer 130-3, a built-in device in a vehicle 130-4, or the like, or any combination thereof. In some embodiments, the mobile device 130-1 may include a smart home device, a wearable device, a smart mobile device, a virtual reality device, an augmented reality device, or the like, or any combination thereof. In some embodiments, the smart home device may include a smart lighting device, a control device of an intelligent electrical apparatus, a smart monitoring device, a smart television, a smart video camera, an interphone, or the like, or any combination thereof. In some embodiments, the wearable device may include a smart bracelet, a smart footgear, a smart glass, a smart helmet, a smart watch, a smart clothing, a smart backpack, a smart accessory, or the like, or any combination thereof. In some embodiments, the smart mobile device may include a smartphone, a personal digital assistant (PDA), a gaming device, a navigation device, a point of sale (POS) device, or the like, or any combination thereof. In some embodiments, the virtual reality device and/or the augmented reality device may include a virtual reality helmet, a virtual reality glass, a virtual reality patch, an augmented reality helmet, an augmented reality glass, an augmented reality patch, or the like, or any combination thereof. For example, the virtual reality device and/or the augmented reality device may include a Google Glass™, an Oculus Rift™, a Hololens™, a Gear VR™, etc. In some embodiments, a built-in device in the vehicle 130-4 may include an onboard computer, an onboard television, etc. In some embodiments, the user terminal 130 may be a device with positioning technology for locating the location of the user (e.g., a driver) of the user terminal 130.

The storage 140 may store data and/or instructions relating to traffic information of the first region. In some embodiments, the storage 140 may store data obtained from the user terminal 130. In some embodiments, the storage 140 may store data and/or instructions that the server 110 may execute or use to perform exemplary methods described in the present disclosure. In some embodiments, the storage 140 may include a mass storage, a removable storage, a volatile read-and-write memory, a read-only memory (ROM), or the like, or any combination thereof. Exemplary mass storage may include a magnetic disk, an optical disk, a solid-state drive, etc. Exemplary removable storage may include a flash drive, a floppy disk, an optical disk, a memory card, a zip disk, a magnetic tape, etc. Exemplary volatile read-and-write memory may include a random access memory (RAM). Exemplary RAM may include a dynamic RAM (DRAM), a double date rate synchronous dynamic RAM (DDR SDRAM), a static RAM (SRAM), a thyristor RAM (T-RAM), and a zero-capacitor RAM (Z-RAM), etc. Exemplary ROM may include a mask ROM (MROM), a programmable ROM (PROM), an erasable programmable ROM (EPROM), an electrically erasable programmable ROM (EEPROM), a compact disk ROM (CD-ROM), and a digital versatile disk ROM, etc. In some embodiments, the storage 140 may be implemented on a cloud platform. Merely by way of example, the cloud platform may include a private cloud, a public cloud, a hybrid cloud, a community cloud, a distributed cloud, an inter-cloud, a multi-cloud, or the like, or any combination thereof.

In some embodiments, the storage 140 may be connected to the network 120 to communicate with one or more components of the traffic monitoring system 100 (e.g., the server 110, the user terminal 130). One or more components of the traffic monitoring system 100 may access the data and/or instructions stored in the storage 140 via the network 120. In some embodiments, the storage 140 may be directly connected to or communicate with one or more components of the traffic monitoring system 100 (e.g., the server 110, the user terminal 130). In some embodiments, the storage 140 may be part of the server 110.

One of ordinary skill in the art would understand that when an element (or component) of the traffic monitoring system 100 performs, the element may perform through electrical signals and/or electromagnetic signals. For example, when the user terminal 130 transmits out driving data (e.g., driving routes of the user) of the user to the server 110, a processor of the user terminal 130 may generate an electrical signal encoding the driving data. The processor of the user terminal 130 may then transmit the electrical signal to an output port. If the user terminal 130 communicates with the server 110 via a wired network, the output port may be physically connected to a cable, which further may transmit the electrical signal to an input port of the server 110. If the user terminal 130 communicates with the server 110 via a wireless network, the output port of the user terminal 130 may be one or more antennas, which convert the electrical signal to electromagnetic signal. Similarly, the user terminal 130 may process a task through operation of logic circuits in its processor, and receive an instruction from the server 110 via electrical signals or electromagnet signals. Within an electronic device, such as the user terminal 130, and/or the server 110, when a processor thereof processes an instruction, transmits out an instruction, and/or performs an action, the instruction and/or action is conducted via electrical signals. For example, when the processor retrieves or saves data from a storage medium (e.g., the storage 140), it may transmit out electrical signals to a read/write device of the storage medium, which may read or write structured data in the storage medium. The structured data may be transmitted to the processor in the form of electrical signals via a bus of the electronic device. Here, an electrical signal refers to one electrical signal, a series of electrical signals, and/or a plurality of discrete electrical signals.

Figure 2:
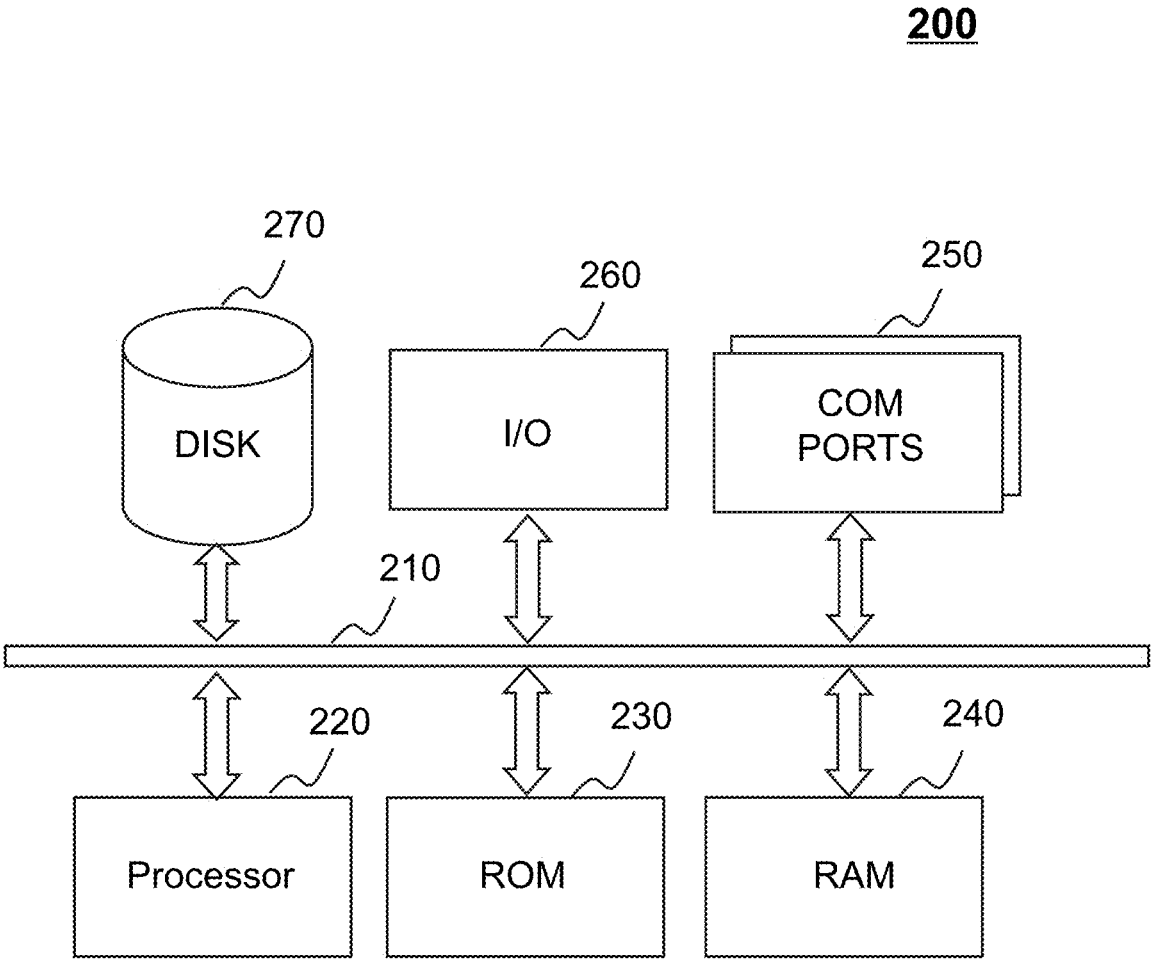
FIG. 2 is a schematic diagram illustrating exemplary hardware and/or software components of a computing device according to some embodiments of the present disclosure.

FIG. 2 is a schematic diagram illustrating exemplary hardware and/or software components of a computing device according to some embodiments of the present disclosure. In some embodiments, the server 110, and/or the user terminal 130 may be implemented on the computing device 200. For example, the processing engine 112 may be implemented on the computing device 200 and configured to perform functions of the processing engine 112 disclosed in this disclosure.

The computing device 200 may be used to implement any component of the traffic monitoring system 100 as described herein. For example, the processing engine 112 may be implemented on the computing device 200, via its hardware, software program, firmware, or a combination thereof. Although only one such computer is shown, for convenience, the computer functions relating to determining the traffic information of the region as described herein may be implemented in a distributed fashion on a number of similar platforms to distribute the processing load.

The computing device 200, for example, may include COM ports 250 connected to and from a network connected thereto to facilitate data communications. The computing device 200 may also include a processor 220, in the form of one or more processors (e.g., logic circuits), for executing program instructions. For example, the processor 220 may include interface circuits and processing circuits therein. The interface circuits may be configured to receive electronic signals from a bus 210, wherein the electronic signals encode structured data and/or instructions for the processing circuits to process. The processing circuits may conduct logic calculations, and then determine a conclusion, a result, and/or an instruction encoded as electronic signals. Then the interface circuits may send out the electronic signals from the processing circuits via the bus 210.

The computing device 200 may further include program storage and data storage of different forms including, for example, a disk 270, and a read only memory (ROM) 230, or a random access memory (RAM) 240, for various data files to be processed and/or transmitted by the computing device. The exemplary computer platform may also include program instructions stored in the ROM 230, RAM 240, and/or other type of non-transitory storage medium to be executed by the processor 220. The methods and/or processes of the present disclosure may be implemented as the program instructions. The computing device 200 also includes an I/O component 260, supporting input/output between the computer and other components. The computing device 200 may also receive programming and data via network communications.

Merely for illustration, only one processor is described in FIG. 2. Multiple processors are also contemplated, thus operations and/or method steps performed by one processor as described in the present disclosure may also be jointly or separately performed by the multiple processors. For example, if in the present disclosure the processor of the computing device 200 executes both step A and step B, it should be understood that step A and step B may also be performed by two different CPUs and/or processors jointly or separately in the computing device 200 (e.g., the first processor executes step A and the second processor executes step B, or the first and second processors jointly execute steps A and B).

Figure 3:
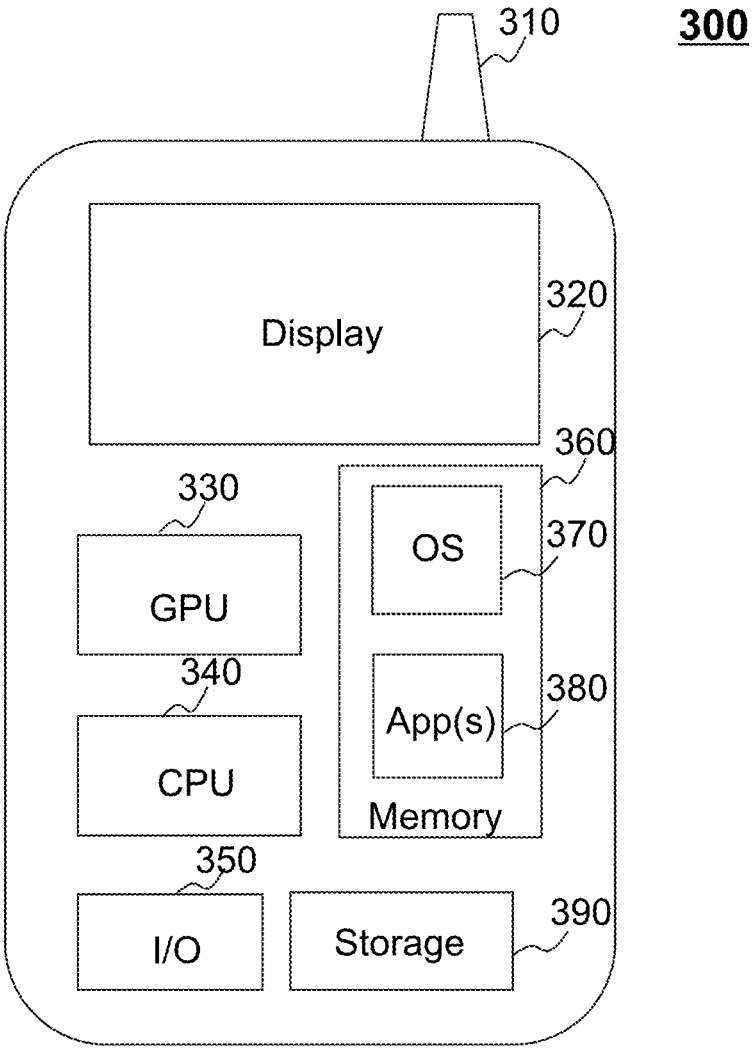
FIG. 3 is a schematic diagram illustrating exemplary hardware and/or software components of a mobile device according to some embodiments of the present disclosure.

FIG. 3 is a schematic diagram illustrating exemplary hardware and/or software components of a mobile device according to some embodiments of the present disclosure. The user terminal 130 may be implemented on the mobile device 300. As illustrated in FIG. 3, the mobile device 300 may include a communication platform 310, a display 320, a graphic processing unit (GPU) 330, a central processing unit (CPU) 340, an I/O 350, a memory 360, a mobile operating system (OS) 370, and a storage 390. In some embodiments, any other suitable component, including but not limited to a system bus or a controller (not shown), may also be included in the mobile device 300.

In some embodiments, the mobile operating system 370 (e.g., iOS™, Android™, Windows Phone™, etc.) and one or more applications 380 may be loaded into the memory 360 from the storage 390 in order to be executed by the CPU 340. The applications 380 may include a browser or any other suitable mobile apps for receiving and rendering information relating to determining the traffic information of the region or other information from the traffic monitoring system 100. User interactions with the information stream may be achieved via the I/O 350 and provided to the processing engine 112 and/or other components of the traffic monitoring system 100 via the network 120.

Figure 4:
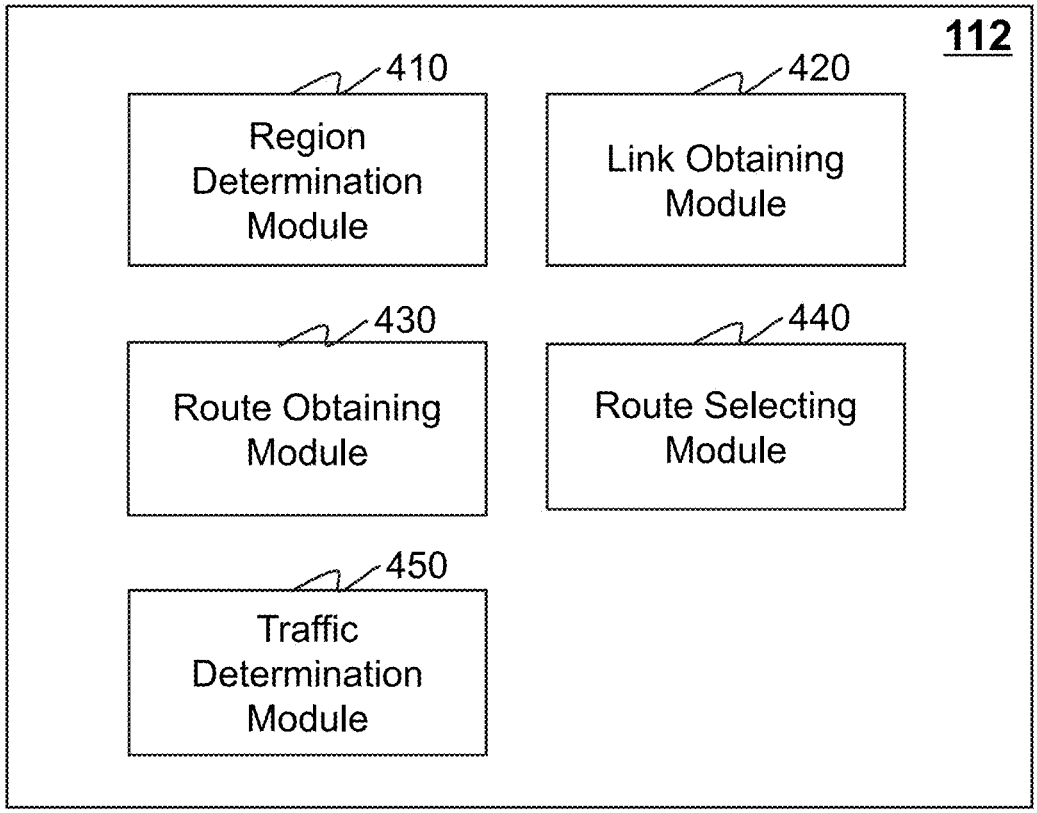
FIG. 4 is a block diagram illustrating an exemplary processing engine according to some embodiments of the present disclosure.

FIG. 4 is a block diagram illustrating an exemplary processing engine according to some embodiments of the present disclosure. The processing engine 112 may include a region determination module 410, a link obtaining module 420, a route obtaining module 430, a route selecting module 440, and a traffic determination module 450.

In some embodiments, the region determination module 410 may be configured to determine a first region and a second region. In some embodiments, the first region may be a geographic region in a city. For example, the first region may include a business district in the city, an airport in the city, a train station in the city, a region inside a beltway of the city (e.g., a region inside the first beltway of Beijing), etc. As another example, the first region may be a region that a user of the traffic monitoring system 100 or a third party (e.g., a traffic control department) is interested in, e.g., a congested region in a city. The second region may contain the first region, i.e., the first region may be inside the second region. For example, the first region may be a region inside the first beltway of Beijing, and the second region may be a region inside the second beltway of Beijing and containing the first beltway of Beijing.

In some embodiments, the region determination module 410 may determine the first region or the second region based on a plurality of points (e.g., GPS location points). The plurality of points may be vertexes of the first region or the second region. For example, the plurality of points may include a location of an office building, a location of a restaurant, an intersection of streets, etc. In some embodiments, the region determination module 410 may determine the first region or the second region based on a plurality of lines (e.g., roads in the city). The plurality of lines may form a first boundary of the first region or a second boundary of the second region. In some embodiments, the region determination module 410 may determine the plurality of points and/or the plurality of lines based on interest of a user of the traffic monitoring system 100 or a third party (e.g., a traffic control department).

Figure 9A:
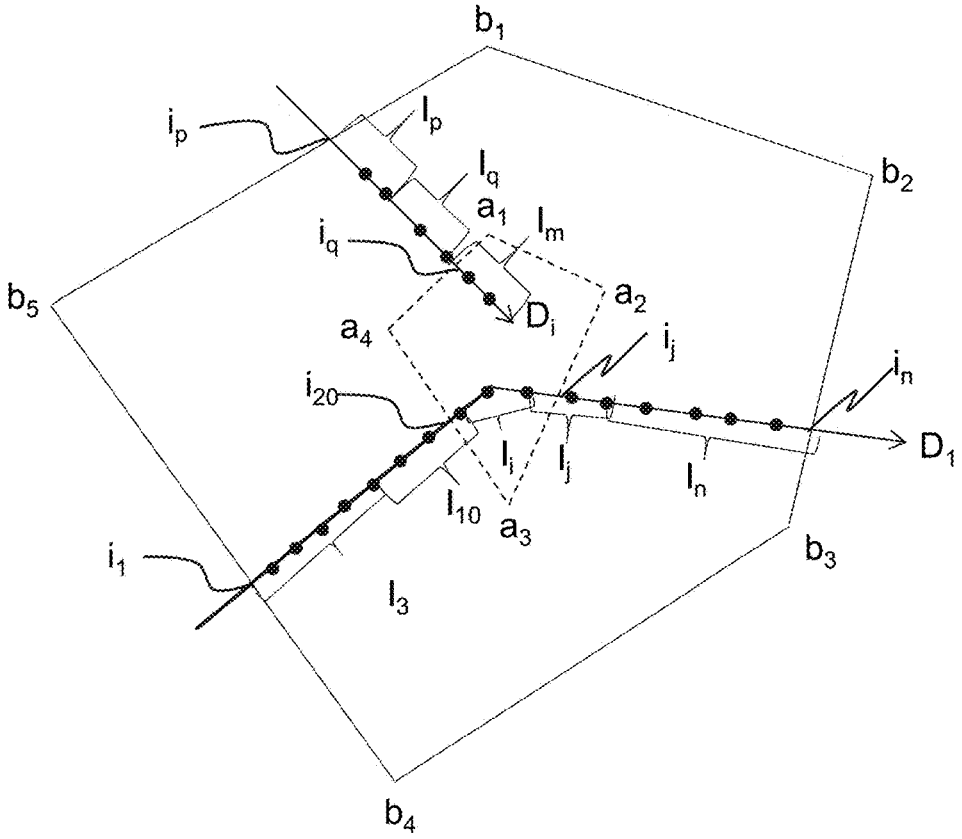
FIGS. 9A-9B are schematic diagrams illustrating an exemplary first region and an exemplary region according to some embodiments of the present disclosure.

In some embodiments, the link obtaining module 420 may be configured to obtain a set of links associated with the first region and the second region. As used herein, a link may refer to a segment of a road. The link may be one-way or two-way. In some embodiments, the set of links may include a plurality of first links inside the first region (e.g., $I_i$ has illustrated in FIG. 9A), a plurality of second links cross the first boundary of the first region (e.g., $I_{10}$, $I_j$, $I_m$ as illustrated in FIG. 9A), a plurality of third links inside the second region other than the first region (e.g., $I_3$, $I_q$, as illustrated in FIG. 9A), and a plurality of fourth links cross the second boundary of the second region (e.g., $I_p$, $I_n$ as illustrated in FIG. 9A).

In some embodiments, the link obtaining module 420 may determine the set of links after the first region and the second region are determined. The link obtaining module 420 may determine the set of links based on a set of points (e.g., GPS location points) associated with the first region and the second region. In some embodiments, the link obtaining module 420 may obtain the set of links from a storage medium (e.g., the storage device 150, the storage 220 of the processing engine 112). The traffic monitoring system 100 or a third party may predetermine links of the city based on the road network of the city. The processing engine 112 may select the set of links from the predetermined links of the city.

In some embodiments, the route obtaining module 430 may be configured to obtain a plurality of driving routes of a plurality of vehicles in the first region and the second region in a predetermined time period. In some embodiments, the plurality of driving routes may include one or more first driving routes inside the first region, one or more second driving routes inside the second region other than the first region, and one or more fourth driving routes that traverse the first boundary or the second boundary.

In some embodiments, the predetermined time period may include a time period including a current time point, or a historical time period. For example, if a current time point is 7 a.m. on Monday, the predetermined time period may be set as 7 a.m.-9 a.m. on the same day. As another example, the time period may be 5 p.m.-7 p.m. in a past day, a week, a month, etc. The predetermined time period may be default settings of the traffic monitoring system 100, or may be adjusted based on real-time traffic conditions.

In some embodiments, if the predetermined time period is a historical time period, the route obtaining module 430 may obtain the plurality of driving routes in the historical time period from a storage medium (e.g., the storage device 150, the storage 220 of the processing engine 112). In some embodiments, if the predetermined time period is a time period including a current time point, the route obtaining module 430 may obtain the plurality of driving routes from a plurality of user terminals 130 in real time.

In some embodiments, the route selecting module 440 may be configured to select one or more driving routes that traverse the first boundary and the second boundary based on the set of links associated with the first region and the second region. In some embodiments, the one or more selected driving routes may include at least one first selected driving route with a travelling direction from the second boundary to the first boundary and at least one second selected driving route with a travelling direction from the first boundary to the second boundary. At least one vehicle may correspond to one of the one or more selected driving route. The at least one first selected driving route may indicate traffic flowing into the first region from the second region. The at least one second selected driving route may indicate traffic flowing out of the first region to the second region.

In some embodiments, the route selecting module 440 may also obtain information related to the one or more selected driving routes. For a selected driving route, the information related to the selected driving route may include one or more points included in the selected driving route, a plurality of driving speeds corresponding to the one or more points, one or more links included in the selected driving route, travelling times corresponding to the one or more points, or the like, or any combination thereof.

In some embodiments, the traffic determination module 450 may be configured to determine traffic information of the first region based on the information related to the one or more selected driving routes. The traffic information may include first traffic information related to the at least one first selected driving route and second traffic information related to the at least one second selected driving route. The first traffic information may indicate traffic flowing into the first region from the second region. The second traffic information may indicate traffic flowing out of the first region to the second region. For example, the traffic information may include whether a road of the first region is congested or smooth, reasons why a road of the first region is congested, or the like, or any combination thereof.

In some embodiments, the traffic determination module 450 may determine the traffic information of the first region based on information related to one or more target routes. As used herein, a target route may be a route between a location where a selected driving route intersects with the first boundary of the first region and a location where the selected driving route intersects with the second boundary of the second region. The one or more target routes may be a portion of the selected driving route, and the information related to the one or more target routes may be a portion of the information related to the selected driving route.

In some embodiments, the traffic determination module 450 may determine the traffic information based on processed information related to the one or more target routes. The traffic determination module 450 may determine the processed information based on the information related to the one or more target routes. For example, the processed information may include a first average speed of vehicles entering the first region from each road of the second boundary of the second region, a first count of vehicles entering the first region from each road of the second boundary of the second region, a first ratio of the first count of vehicles to a total count of vehicles entering the first region from the each road of the second boundary of the second region, a second average speed of vehicles exiting the first region to each road of the second boundary of the second region, a second count of vehicles exiting the first region to each road of the second boundary of the second region, a second ratio of the second count of vehicles to a total count of vehicles exiting the first region to each road of the second boundary of the second region, or the like, or any combination thereof.

The modules in the processing engine 112 may be connected to or communicated with each other via a wired connection or a wireless connection. The wired connection may include a metal cable, an optical cable, a hybrid cable, or the like, or any combination thereof. The wireless connection may include a Local Area Network (LAN), a Wide Area Network (WAN), a Bluetooth, a ZigBee, a Near Field Communication (NFC), or the like, or any combination thereof. Two or more of the modules may be combined into a single module, and any one of the modules may be divided into two or more units. For example, the link obtaining module 420 and the route obtaining module 430 may be combined as a single module which may both obtain the set of links associated with the first region and the second region, and obtain the plurality of driving routes of the plurality of vehicles in the first region and the second region in the predetermined time period. As another example, the processing engine 112 may include a storage module (not shown) which may be used to store data generated by the above-mentioned modules.

Figure 5:
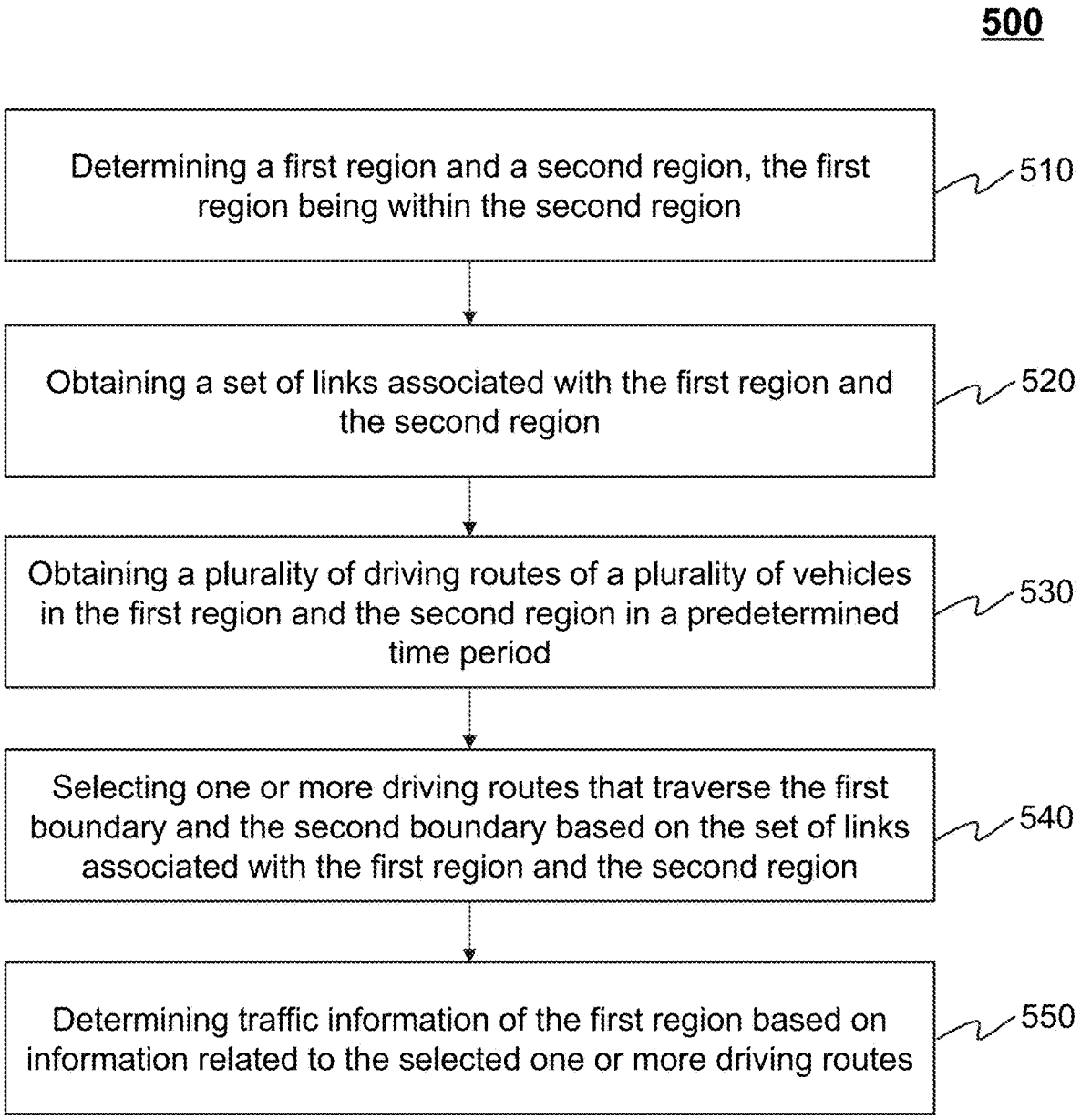
FIG. 5 is a flowchart illustrating an exemplary process for determining traffic information of a first region according to some embodiments of the present disclosure.

FIG. 5 is a flowchart illustrating an exemplary process for determining traffic information of a first region according to some embodiments of the present disclosure. In some embodiments, the process 500 may be implemented as a set of instructions (e.g., an application) stored in the storage ROM 230 or RAM 240. The processor 220 and/or modules in FIG. 4 may execute the set of instructions, and when executing the instructions, the processor 220 and/or the modules may be configured to perform the process 500. The operations of the illustrated process presented below are intended to be illustrative. In some embodiments, the process 500 may be accomplished with one or more additional operations not described and/or without one or more of the operations herein discussed. Additionally, the order in which the operations of the process as illustrated in FIG. 5 and described below is not intended to be limiting.

In 510, the processing engine 112 (e.g., the region determination module 410 or the interface circuits of the processor 220) may determine a first region and a second region, the first region being within the second region. In some embodiments, the first region may be a geographic region in a city. For example, the first region may include a business district in the city, an airport in the city, a train station in the city, a region inside a beltway of the city (e.g., a region inside the first beltway of Beijing), etc. As another example, the first region may be a region that a user of the traffic monitoring system 100 or a third party (e.g., a traffic control department) is interested in, e.g., a congested region in a city. As used herein, the congested region may refer to a region with a relatively high traffic flow comparing to other regions of the city. As a result, the average speed of vehicles traveling in the congested region may be slower than in other regions.

In some embodiments, the region determination module 410 may determine the first region based on a plurality of first points (e.g., point $a_1$, $a_2$, $a_3$, $a_4$ as illustrated in FIG. 9A). The plurality of first points may be vertexes of the first region. The region determination module 410 may determine the first region by connecting the plurality of first points. In some embodiments, the region determination module 410 may determine the plurality of first points based on the region of interest. For example, if a user of the traffic monitoring system 100 or a third party (e.g., a traffic control department) wants to analyze traffic information near Beijing train station, the processing engine 112 may determine the plurality of first points based on a geographic region forming a reference boundary that contains the Beijing train station, and the plurality of first points may be vertexes of the reference boundary of the Beijing train station. For example, the plurality of first points may include a location of an office building, a location of a restaurant, an intersection of streets, etc.

In some embodiments, the region determination module 410 may determine a plurality of first lines (e.g., $a_1a_2$, $a_2a_3$, $a_3a_4$, $a_4a_1$, as illustrated in FIG. 9A). The plurality of first lines may represent a plurality of roads in the city. The plurality of first lines may form a first boundary of the first region. The region determination module 410 may determine the first region based on the plurality of first lines. In some embodiments, the region determination module 410 may determine the plurality of first lines based on the region of interest. For example, if a user of the traffic monitoring system 100 or a third party (e.g., a traffic control department) wants to analyze traffic information of a region inside the first beltway of Beijing, the processing engine 112 may determine the first lines based on a geographic region forming a reference boundary that contains the region inside the first beltway of Beijing, and the first lines may form the reference boundary.

The region determination module 410 may also determine a second region e.g., based on the first region. The second region may contain the first region, i.e., the first region may be inside the second region. For example, the first region may be a region inside the first beltway of Beijing, and the second region may be a region inside the second beltway of Beijing and containing the first beltway of Beijing.

In some embodiments, the region determination module 410 may determine the second region based on a plurality of second lines (e.g., $b_1b_2$, $b_2b_3$, $b_3b_4$, $b_4b_5$, $b_5b_1$ as illustrated in FIG. 9A). The plurality of second lines may represent a plurality road outside the first region, and the plurality of lines may form a second boundary of the second region. In some embodiments, the region determination module 410 may determine the plurality of second lines based on the region of interest. For example, if a user of the traffic monitoring system 100 or a third party (e.g., a traffic control department) wants to analyze traffic flows in and out of a region inside the first beltway of Beijing via a plurality of particular roads, the processing engine 112 may determine the plurality of second lines based on the plurality of particular roads. In some embodiments, the plurality of second lines may form a reference boundary (i.e., the second boundary of the second region) of a geographic region determined by the plurality of particular roads.

In some embodiments, the region determination module 410 may determine the second region based on a plurality of second points (e.g., point $b_1$, $b_2$, $b_3$, $b_4$, $b_5$ as illustrated in FIG. 9A) associated with the second region. The plurality of second points may be outside the first region, and the plurality of second points may constitute vertexes of the second region. The region determination module 410 may determine the second region by connecting the plurality of second points. In some embodiments, the region determination module 410 may determine the plurality of second points based on the region of interest. For example, the processing engine 112 may determine a reference boundary of a geographic region including a plurality of particular roads that a user of the traffic monitoring system 100 or a third party is interested in according to the process described above. The second points may be vertexes of the geographic region including the plurality of particular roads.

In 520, the processing engine 112 (e.g., the link obtaining module 420 or the interface circuits of the processor 220) may obtain a set of links associated with the first region and the second region. As used herein, a link may refer to a segment of a road. The link may be one-way or two-way. In some embodiments, the set of links may include a plurality of first links inside the first region (e.g., $I_i$ as illustrated in FIG. 9A), a plurality of second links cross the first boundary of the first region (e.g., $I_{10}$, $I_j$, $I_m$ as illustrated in FIG. 9A), a plurality of third links inside the second region other than the first region (e.g., $I_3$, $I_q$, as illustrated in FIG. 9A), and a plurality of fourth links cross the second boundary of the second region (e.g., $I_p$, $I_n$ as illustrated in FIG. 9A).

In some embodiments, the processing engine 112 may determine the set of links after the first region and the second region are determined. The processing engine 112 may determine the set of links based on a set of points associated with the first region and the second region. The processing engine 112 may locate the set of points based on positioning techniques. As described above, the positioning technique may include a global positioning system (GPS), a global navigation satellite system (GLONASS), a compass navigation system (COMPASS), a Galileo positioning system, a quasi-zenith satellite system (QZSS), a wireless fidelity (WiFi) positioning technology, or the like, or any combination thereof. In some embodiments, the processing engine 112 may collect each adjacent points within a certain time interval (e.g., 2*s*, 3*s*) based on the positioning techniques. The processing engine 112 may determine the set of link by connecting one or more points (e.g., 2 points, 3 points, 5 points) among the set of points.

In some embodiments, the processing engine 112 may obtain the set of links from a storage medium (e.g., the storage device 150, the storage 220 of the processing engine 112). The traffic monitoring system 100 or a third party may predetermine links of the city based on the road network of the city. The processing engine 112 may select the set of links from the predetermined links of the city. The process for predetermining the links of the city may be similar to the process for determining the set of links described above, and more detailed descriptions may be not repeated here.

In 530, the processing engine 112 (e.g., the route obtaining module 430 or the interface circuits of the processor 220) may obtain a plurality of driving routes of a plurality of vehicles in the first region and the second region in a predetermined time period. In some embodiments, the plurality of driving routes may include one or more first driving routes inside the first region, one or more second driving routes inside the second region other than the first region, and one or more fourth driving routes that traverse the first boundary or the second boundary.

The one or more fourth driving routes may indicate traffic flows into the first region from the second boundary of the second region or traffic flows out of the first region to the second boundary in the predetermined time period. For example, if a total count of the one or more fourth driving routes is greater than a threshold (e.g., a capacity constraint of the first region), at least one road along the one or more fourth driving routes may be congested.

In some embodiments, for a driving route (e.g., $D_1$, $D_i$ as illustrated in FIG. 9A) among the plurality of driving routes, the driving route (e.g., $D_1$ as illustrated in FIG. 9A) may include one or more sequentially connected links (e.g., $I_3$, $I_{10}$, $I_i$, $I_j$ as illustrated in FIG. 9A) among the set of links, and each of the one or more sequentially connected links may include one or more points from the set of points.

In some embodiments, the predetermined time period may include a time period including a current time point, or a historical time period. For example, if a current time point is 7 a.m. on Monday, the predetermined time period may be set as 7 a.m.-9 a.m. on the same day. As another example, the time period may be 5 p.m.-7 p.m. in a past day, a week, a month, etc. The predetermined time period may be default settings of the traffic monitoring system 100, or may be adjusted based on real-time traffic conditions.

In some embodiments, if the predetermined time period is a historical time period, the processing engine 112 may obtain the plurality of driving routes in the historical time period from a storage medium (e.g., the storage device 150, the storage 220 of the processing engine 112). In some embodiments, if the predetermined time period is a time period including a current time point, the processing engine 112 may obtain the plurality of driving routes from a plurality of user terminals 130 in real time.

In 540, the processing engine 112 (e.g., the route selecting module 440 or the interface circuits of the processor 220) may select one or more driving routes that traverse the first boundary and the second boundary based on the set of links associated with the first region and the second region. As described in connection with 530, each driving route of the plurality of driving routes may include one or more sequentially connected links among the set of links. If one driving route (e.g., $D_1$, $D_i$ as illustrated in FIG. 9A) of the plurality of driving routes includes a link intersecting with the first boundary and a link intersecting with the second boundary, the processing engine 112 may select the driving route as one of the one or more driving routes that traverse the first boundary and the second boundary. In some embodiments, the one or more selected driving routes may include at least one first selected driving route with a travelling direction from the second boundary to the first boundary and at least one second selected driving route with a travelling direction from the first boundary to the second boundary. At least one vehicle may correspond to one of the one or more selected driving route. The at least one first selected driving route may indicate traffic flowing into the first region from the second region. The at least one second selected driving route may indicate traffic flowing out of the first region to the second region.

In some embodiments, the processing engine 112 may also obtain information related to the one or more selected driving routes. For a selected driving route, the information related to the selected driving route may include one or more points included in the selected driving route, a plurality of driving speeds corresponding to the one or more points, one or more links included in the selected driving route, travelling times corresponding to the one or more points, or the like, or any combination thereof.

In 550, the processing engine 112 (e.g., the traffic determination module 450 or the interface circuits of the processor 220) may determine traffic information of the first region based on the information related to the one or more selected driving routes. The traffic information may include first traffic information related to the at least one first selected driving route and second traffic information related to the at least one second selected driving route. The first traffic information may indicate traffic flowing into the first region from the second region. The second traffic information may indicate traffic flowing out of the first region to the second region. For example, the traffic information may include whether a road of the first region is congested or smooth, reasons why a road of the first region is congested, or the like, or any combination thereof.

In some embodiments, the processing engine 112 may determine the traffic information of the first region based on information related to one or more target routes. As used herein, a target route may be a route between a location where a selected driving route intersects with the first boundary of the first region and a location where the selected driving route intersects with the second boundary of the second region. The one or more target routes may be a portion of the selected driving route, and the information related to the one or more target routes may be a portion of the information related to the selected driving route. For example, if a driving route is along $point_A$, $point_B$, $point_C$, $point_A$, $point_E$, and $point_F$, $point_B$ is a location where a selected driving route intersects with the first boundary of the first region, and $point_E$ is a location where the selected driving route intersects with the second boundary of the second region, the target route may be along $point_B$, $point_C$, $point_D$, and $point_E$. More detailed descriptions of the target route can be found elsewhere in the present disclosure, e.g., FIG. 6 and the descriptions thereof.

In some embodiments, the processing engine 112 may determine the traffic information based on processed information related to the one or more target routes. The processing engine 112 may determine the processed information based on the information related to the one or more target routes. For example, the processed information may include a first average speed of vehicles entering the first region from each road of the second boundary of the second region, a first count of vehicles entering the first region from each road of the second boundary of the second region, a first ratio of the first count of vehicles to a total count of vehicles entering the first region from the each road of the second boundary of the second region, a second average speed of vehicles exiting the first region to each road of the second boundary of the second region, a second count of vehicles exiting the first region to each road of the second boundary of the second region, a second ratio of the second count of vehicles to a total count of vehicles exiting the first region to each road of the second boundary of the second region, or the like, or any combination thereof. More detailed descriptions of the processed information can be found elsewhere in the present disclosure, e.g., FIGS. 7-8 and the descriptions thereof.

In some embodiments, the processing engine 112 may determine whether one target route is a hot route based on the traffic information of the first region. As used herein, the hot route may refer to a route that has a relatively large count of vehicles traveling through. In some embodiments, the processing engine 112 may determine whether the target route satisfies a predetermined condition. For example, the predetermined condition may include whether an average speed of vehicles traveling through the target route is smaller than a predetermined speed threshold, whether a count of vehicles traveling through the target route is greater than a predetermined count threshold, whether a ratio for the target route is greater than a predetermined ratio threshold. As used herein, the ratio for the target route may refer to a ratio of a count of vehicles entering the first region by travelling through the target route to a total count of vehicles entering the first region from the second boundary of the second region or a ratio of a count of vehicles leaving the first region by travelling through the target route to a count of a total count of vehicles leaving the first region to the second boundary of the second region. In response to a determination that the target route satisfies the predetermined condition, the processing engine 112 may further determine the target route as the hot route.

In some embodiments, the traffic information or the one or more hot routes may be used for navigation. In some embodiments, the processing engine 112 may upload the traffic information or the one or more hot routes to a server of a navigation system. When a user drives around or in the first region or the second region, the navigation system may broadcast and/or display the traffic information or the one or more hot routes on a user interface of the navigation system. If a destination of the driver is inside the first region and at least one road in the first region is congested, the navigation system may recommend at least one suitable routes (e.g., with less congestion) to the destination of the user. The user may select an alternative route from the at least one suitable routes. For example, if a ratio with respect to a road of a second boundary is greater than a ratio threshold, the processing engine 112 may recommend the vehicle to detour the second boundary of the second region (e.g., to a road of the second boundary with a smaller ratio) before entering the second region. As used herein, the ratio with respect to the road of the second boundary may refer to a ratio of a count of vehicles entering the first region from the road to a total count of vehicles entering the first region from each road of the second boundary of the second region. In some embodiments, the traffic information of the first region and/or the one or more hot routes may be used to control the traffic of the first region. The processing engine 112 may transmit the traffic information of the first region and the hot routes to a third party (e.g., a traffic control department). The third party may control the traffic of the first region based on the traffic information of the first region and the hot routes. For example, if the traffic information of a hot route indicates that vehicles are traveling slower than a normal speed along the hot route, i.e., at least one road along the hot route is a congested, the traffic control department may alleviate traffic congestion of the at least one road. As another example, the traffic control department may detour the vehicles heading toward the at least one congested road to alleviate the traffic congestion.

In some embodiments, the third party, e.g., a traffic control department, may alleviate traffic congestion of the at least one road by adjusting traffic light cycles of intersections near the at least one congested road based on the traffic information and/or the hot routes. For example, the third party may adjust a ratio of the green light cycle to the red light cycle along a congested road to increase the duration of the green lights. As another example, the third party may detour the vehicles heading toward the at least one congested road from nearby intersections to alleviate the traffic congestion.

It should be noted that the above description is provided for the purpose of illustration, and is not intended to limit the scope of the present disclosure. For persons having ordinary skills in the art, multiple variations and modifications may be made under the teaching of the present disclosure. However, those variations and modifications do not depart from the scope of the present disclosure. For example, the processing engine 112 may determine the first region and a plurality of target routes in 510. The plurality of target routes may include roads that a user of the traffic monitoring system 100 or a third party wants to analyze. For example, the plurality of target routes may include roads entering and exiting the first region.

Figure 6:
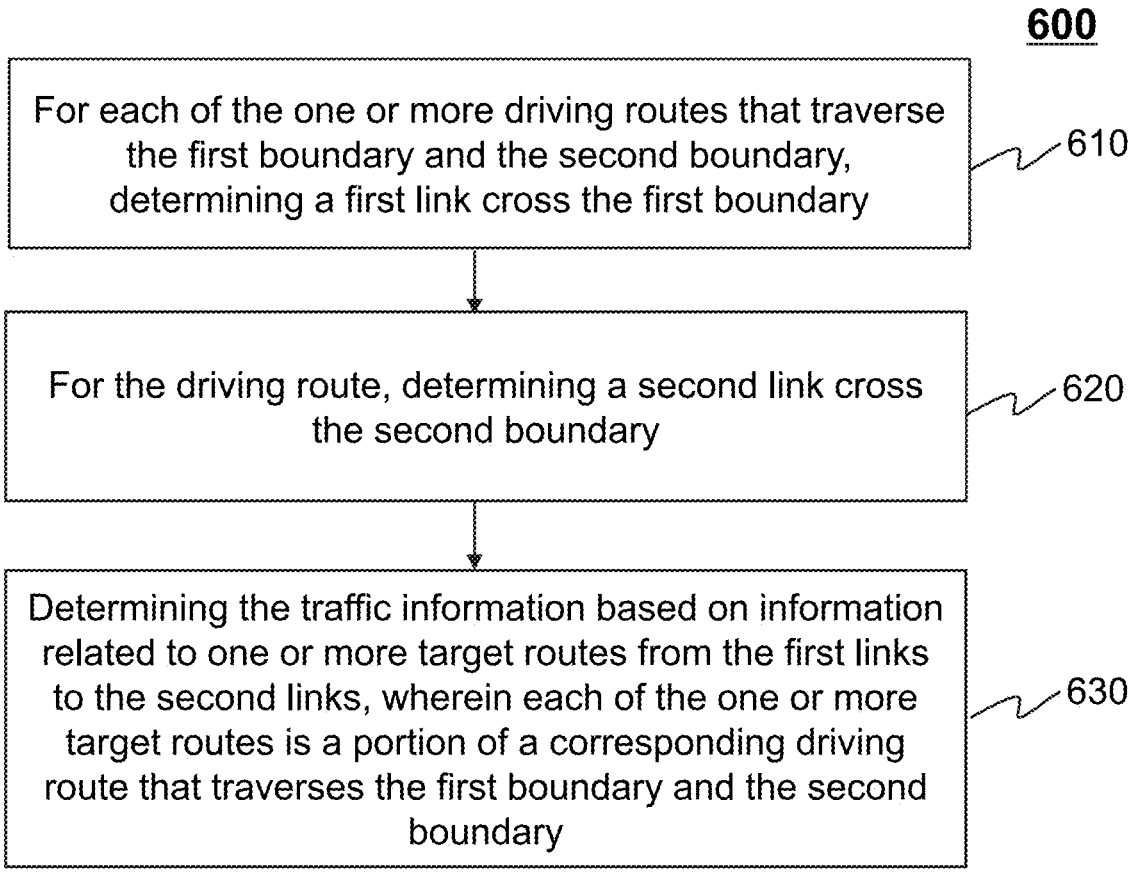
FIG. 6 is a flowchart illustrating an exemplary process for determining traffic information of a first region according to some embodiments of the present disclosure.

FIG. 6 is a flowchart illustrating an exemplary process for determining traffic information of a first region according to some embodiments of the present disclosure. In some embodiments, the process 600 may be implemented as a set of instructions (e.g., an application) stored in the storage ROM 230 or RAM 240. The processor 220 and/or modules in FIG. 4 may execute the set of instructions, and when executing the instructions, the processor 220 and/or the modules may be configured to perform the process 600. The operations of the illustrated process presented below are intended to be illustrative. In some embodiments, the process 600 may be accomplished with one or more additional operations not described and/or without one or more of the operations herein discussed. Additionally, the order in which the operations of the process as illustrated in FIG. 6 and described below is not intended to be limiting. In some embodiments, operation 550 of the process 500 may be performed based on the process 600.

In 610, the processing engine 112 (e.g., the traffic determination module 450 or the interface circuits of the processor 220) may determine a first link cross the first boundary for each of the one or more driving routes that traverse the first boundary and the second boundary selected in 540. As described in FIG. 5, the each of the one or more driving routes may include one or more links from the set of links, and the processing engine 112 may select the first link cross the first boundary among the one or more links. The first link may indicate a segment of road via which, a vehicle begins to enter or exit the first region. For example, if a driving direction of a vehicle is toward the first region, the vehicle may enter the first region. As another example, if a driving direction of a vehicle is toward the second region other than the first region, the vehicle may exit the first region.

In 620, for the each of the one or more driving routes that traverse the first boundary and the second boundary, the processing engine 112 (e.g., the traffic determination module 450 or the interface circuits of the processor 220) may determine a second link cross the second boundary. The processing engine 112 may select the second link cross the second boundary among the one or more links described above. The second link may indicate a segment of road via which, a vehicle begins to enter or exit the second region. For example, if a driving direction of a vehicle is toward the first region, the vehicle may enter the first region. As another example, if a driving direction of a vehicle is toward the second region other than the first region, the vehicle may exit the first region.

In some embodiments, taking a driving route that traverses the first boundary and the second boundary as an example, the processing engine 112 may also determine a target route based on the first link and the second link. The target route may correspond to the driving route and the target route may be a portion of the driving route. In some embodiments, the target route may be a route from the first link to the second link or a route from the second link to the first link. For example, if a driving route includes $link_1$, $link_3$, $link_4$, $link_7$, $link_{10}$, and $link_{11}$, links is the first link, and $link_{10}$ is the second link, a target route corresponding to the driving route may be a route including $link_3$, $link_4$, $link_7$, and $link_{10}$.

In some embodiments, for a target link from a first link to a second link, links between the first link and the second link may be inside the second region other than the first region. For example, if a target link includes $link_3$, $link_4$, $link_7$, and $link_{10}$, links is the first link, and $link_{10}$ is the second link, $link_4$ and $link_7$ are inside the second region other than the first region. As another example, if a target link includes $link_{10}$, $link_7$, $link_4$, $link_3$, $link_3$ is the first link, and $link_{10}$ is the second link, $link_7$ and $link_4$ are inside the second region other than first region.

In 630, the processing engine 112 (e.g., the traffic determination module 450 or the interface circuits of the processor 220) may determine the traffic information based on information related to one or more target routes from the first links to the second links. As described in connection with 540 or 620, a target route corresponding to the selected driving route may be a portion of the selected driving route. The information related to the target route may be a portion of the information related to the selected driving route. For example, the information related to the target route may include one or more points included in the target route, one or more driving speeds corresponding to the one or more points, one or more links included in the target route, travelling times corresponding to the one or more points, or the like, or any combination thereof.

It should be noted that the above description is merely provided for the purposes of illustration, and not intended to limit the scope of the present disclosure. For persons having ordinary skills in the art, multiple variations or modifications may be made under the teachings of the present disclosure. However, those variations and modifications do not depart from the scope of the present disclosure.

Figure 7:
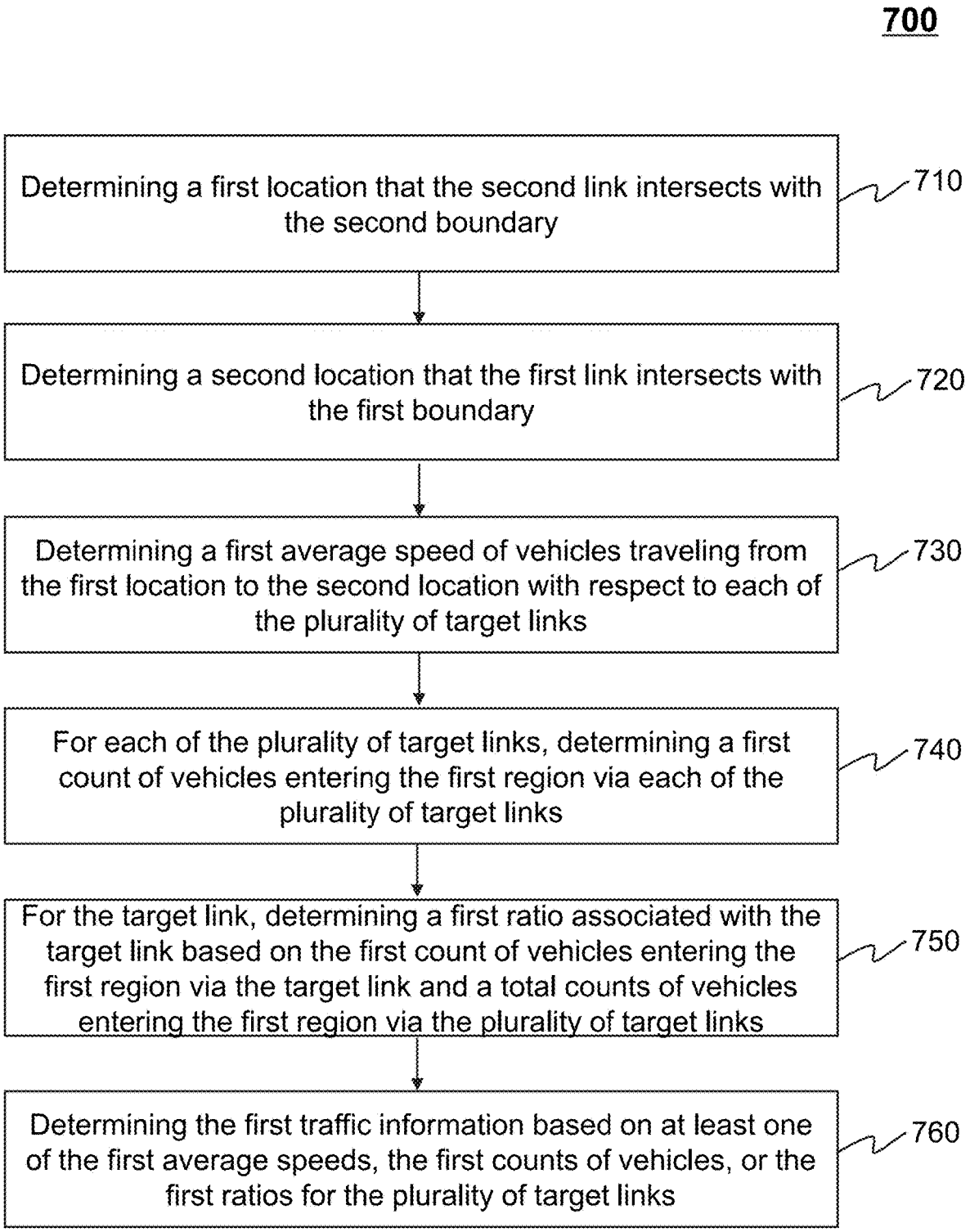
FIG. 7 is a flowchart illustrating an exemplary process for determining first traffic information flowing into a first region from a second region according to some embodiments of the present disclosure.

FIG. 7 is a flowchart illustrating an exemplary process for determining first traffic information flowing into a first region from a second region according to some embodiments of the present disclosure. In some embodiments, the process 700 may be implemented as a set of instructions (e.g., an application) stored in the storage ROM 230 or RAM 240. The processor 220 and/or modules in FIG. 4 may execute the set of instructions, and when executing the instructions, the processor 220 and/or the modules may be configured to perform the process 700. The operations of the illustrated process presented below are intended to be illustrative. In some embodiments, the process 700 may be accomplished with one or more additional operations not described and/or without one or more of the operations herein discussed. Additionally, the order in which the operations of the process as illustrated in FIG. 7 and described below is not intended to be limiting. In some embodiments, the determination of the first traffic information in 550 or in 630 may be performed based on the process 700.

In 710, for each of the target route, the processing engine 112 (e.g., the traffic determination module 450 or the interface circuits of the processor 220) may determine a first location (e.g., $i_1$, $i_p$, $i_n$ as illustrated in FIG. 9A) that the second link intersects with the second boundary.

In 720, for the each of the target route, the processing engine 112 (e.g., the traffic determination module 450 or the interface circuits of the processor 220) may determine a second location (e.g., $i_{20}$, $i_j$, $i_q$ as illustrated in FIG. 9A) that the first link intersects with the first boundary.

In 730, each of the plurality of target links (i.e., roads of the second boundary of the second region), the processing engine 112 (e.g., the traffic determination module 450 or the interface circuits of the processor 220) may determine a first average speed of vehicles travelling from the first location to the second location. As described above, the first location may be an intersection between a target route (or a corresponding driving route) and the second boundary, and the second location may be an intersection between the target route (or the corresponding driving route) and the first boundary. Thus a vehicle travelling from the first location to the second location may indicate that the vehicle enters the first region from the second boundary (e.g., one target link of the plurality of target links) of the second region. In some embodiments, the first average speed may represent an average speed of vehicles entering the first region from the each of the plurality of target links. The processing engine 112 may determine the first average speed of vehicles based on a speed of each of the vehicles entering the first region from the each of the plurality of target links. In some embodiments, the first average speed of vehicles may be an average of the speeds of vehicles. In some embodiments, assuming that a vehicle drives at a constant speed, a speed of the vehicle travelling from the first location to the second location may be equal to a speed of the vehicle travelling along a corresponding target route described in 550. Therefore, for a target link, the first average speed of vehicles may be equal to an average speed of vehicles entering the first region from the target link along a corresponding target route.

In some embodiments, the processing engine 112 may determine the speed of the vehicle based on a first travelling time from the first location to the second location and a first travelling distance from the first location to the second location. The speed of the vehicle may be a ratio of the first travelling distance to the first travelling time. In some embodiments, the processing engine 112 may determine the speed of the vehicle based on speeds corresponding to a plurality of points included in the route from the first location to the second location. Each point may correspond to a speed of the vehicle at a corresponding time point. The first average speed may be an average of the speeds of points included in the route from the first location to the second location.

In 740, for each of the plurality of target links (i.e., roads of the second boundary of the second region), the processing engine 112 (e.g., the traffic determination module 450 or the interface circuits of the processor 220) may determine a first count of vehicles entering the first region via each of the plurality of target links. Each route may correspond to a vehicle, and the first count of vehicles may be equal to a count of at least one target route (or the routes from the first location to the second location) entering the first region from each of the plurality of target links.

In 750, for a target link, the processing engine 112 (e.g., the traffic determination module 450 or the interface circuits of the processor 220) may determine a first ratio associated with the target link based on the first count of vehicles entering the first region via the target link and a total count of vehicles entering the first region via the plurality of target links. In some embodiments, the processing engine 112 may first determine the total count of vehicles by summing the first counts of vehicles entering the first region from the plurality of target links. The first ratios may be ratios of the first counts of vehicles to the total count of vehicles.

In 760, the processing engine 112 (e.g., the traffic determination module 450 or the interface circuits of the processor 220) may determine the first traffic information based on at least one of the first average speeds, the first counts of vehicles, or the first ratios for the plurality of target links.

Figure 8:
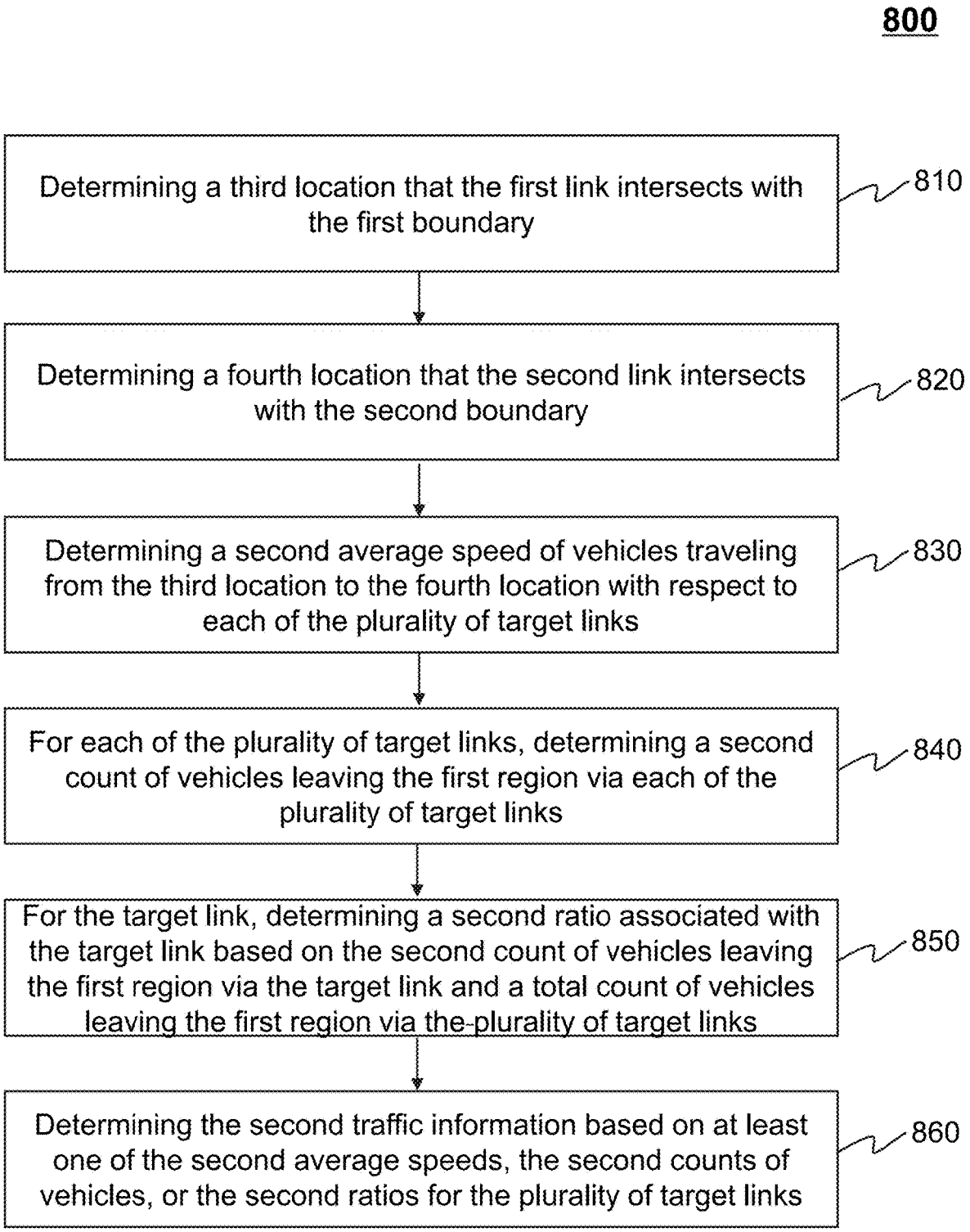
FIG. 8 is a flowchart illustrating an exemplary process for determining second traffic information flowing out of a first region to a second region according to some embodiments of the present disclosure.

FIG. 8 is a flowchart illustrating an exemplary process for determining second traffic information flowing out of a first region to a second region according to some embodiments of the present disclosure. In some embodiments, the process 800 may be implemented as a set of instructions (e.g., an application) stored in the storage ROM 230 or RAM 240. The processor 220 and/or modules in FIG. 4 may execute the set of instructions, and when executing the instructions, the processor 220 and/or the modules may be configured to perform the process 800. The operations of the illustrated process presented below are intended to be illustrative. In some embodiments, the process 800 may be accomplished with one or more additional operations not described and/or without one or more of the operations herein discussed. Additionally, the order in which the operations of the process as illustrated in FIG. 8 and described below is not intended to be limiting. In some embodiments, operation 630 may be performed based on the process 800.

In 810, the processing engine 112 (e.g., the traffic determination module 450 or the interface circuits of the processor 220) may determine a third location (e.g., $i_{20}$, $i_j$, $i_q$ as illustrated in FIG. 9A) that the first link intersects with the first boundary.

In 820, the processing engine 112 (e.g., the traffic determination module 450 or the interface circuits of the processor 220) may determine a fourth location (e.g., $i_1$, $i_p$, $i_n$ as illustrated in FIG. 9A) that the second link intersects with the second boundary.

In 830, the processing engine 112 (e.g., the traffic determination module 450 or the interface circuits of the processor 220) may determine a second average speed of vehicles travelling from the third location to the fourth location with respect to each of the plurality of target links. As described above, the first location may be an intersection between a target route (or a corresponding driving route) and the second boundary, and the second location may be an intersection between the target route (or the corresponding driving route) and the first boundary. Thus a vehicle travelling from the second location to the first location may indicate that the vehicle leaves the first region to the second boundary (e.g., one link of the plurality of target links) of the second region. In some embodiments, the second average speed may represent an average speed of vehicles leaving the first region to the each of the plurality of target links. The processing engine 112 may determine the second average speed of vehicles based on a speed of each of the vehicles leaving the first region to the each of the plurality of target links. The second average speed of vehicles may be an average of the speeds of the vehicles. In some embodiments, assuming that a vehicle driving at a constant speed, a speed of the vehicle travelling from the first location to the second location may be equal to a speed of the vehicle travelling along a corresponding target route described in 550. Therefore, for a target link, the second average speed of vehicles may be equal to an average speed of vehicles leaving the first region to the target link along a corresponding target route. A process for determining the speed of vehicles can be found elsewhere in the present disclosure, e.g., operation 730 and the descriptions thereof.

In 840, the processing engine 112 (e.g., the traffic determination module 450) (e.g., the interface circuits of the processor 220) may determine a second count of vehicles leaving the first region via each of the plurality of target links. Each route may correspond to a vehicle, and the second count of vehicles may be equal to a count of at least one target route (or the routes determined from the third location to the fourth location) leaving the first region to the each of the plurality of target links.

In 850, for a target link, the processing engine 112 (e.g., the traffic determination module 450 or the interface circuits of the processor 220) may determine a second ratio associated with the target link based on the second count of vehicles leaving the first region via the target link and a total count of vehicles leaving the first region via the plurality of target links. In some embodiments, the processing engine 112 may first determine the total count of vehicles by summing the second counts of vehicles leaving the first region via the plurality of target links. The second ratios may be ratios of the second counts of vehicles to the total count of vehicles.

In 860, the processing engine 112 (e.g., the traffic determination module 450 or the interface circuits of the processor 220) may determine the second traffic information based on at least one of the second average speeds, the second counts of vehicles, or the second ratios for the plurality of target links.

Figure 9B:
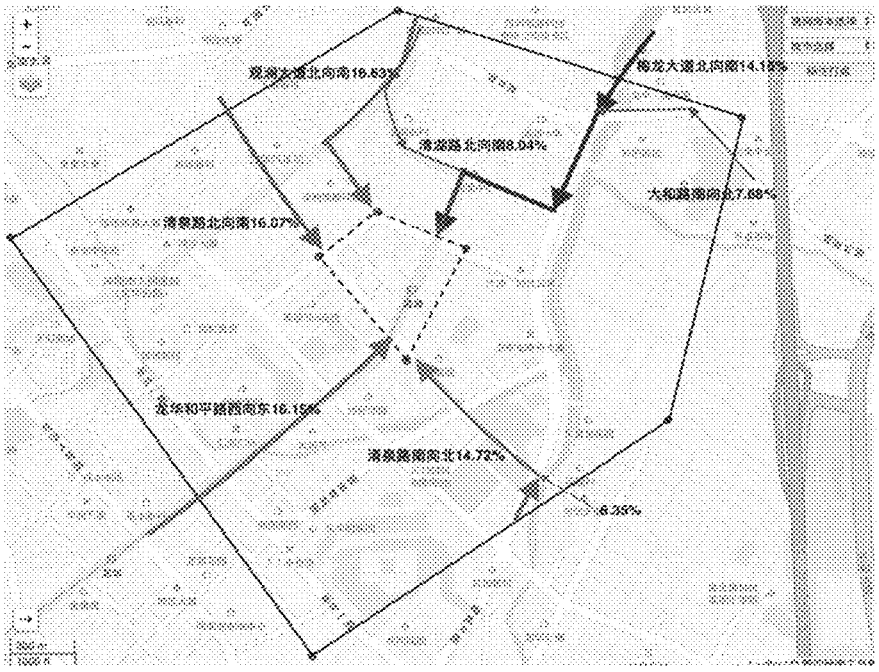

FIGS. 9A-9B are schematic diagrams illustrating an exemplary first region and an exemplary second region according to some embodiments of the present disclosure.

As described elsewhere in the present disclosure, the processing engine 112 may determine a first region and a second region. The first region may be inside the second region. The processing engine 112 may determine the first region based on a plurality of first points or a plurality of first lines (or links) (i.e., a first boundary of a first region). The processing engine 112 may determine the second region based on a plurality of second points and a plurality of target lines (or links) (i.e., a second boundary of a second region). As illustrated in FIG. 9, point $a_1$, $a_2$, $a_3$, and $a_4$ corresponds to the plurality of first points, and $a_1a_2$, $a_2a_3$, $a_3a_4$, and $a_4a_1$ corresponds to the plurality of first links. Point $b_1$, $b_2$, $b_3$, $b_4$, and $b_5$ corresponds to the plurality of second points, and $b_1b_2$, $b_2b_3$, $b_3b_4$, $b_4b_5$, and $b_5b_1$ corresponds to the plurality of target lines.

As described elsewhere in the present disclosure, the processing engine 112 may select one or more driving routes that traverse the first boundary and the second boundary. Each of the one or more driving routes may include one or more links, and each link of the one or more links may include one or more points (e.g., GPS location points). The processing engine 112 may determine one or more target routes corresponding to the one or more driving routes. Each of the one or more target routes may be a portion (e.g., a route from a link cross the first/second boundary to a link cross the second/first boundary) of a corresponding driving route. As illustrated in FIG. 9A, $D_1$ and $D_i$ are two driving routes of the one or more driving routes. $D_1$ includes $I_3$, $I_{10}$, $I_i$, $I_j$, and $I_n$. The one or more points included in $D_1$ are dots along $D_1$. $D_i$ includes $I_p$, $I_q$, and $I_m$. The one or more points included in $D_i$ are dots along $D_i$. $i_1i_{20}$, $i_ji_n$, are two target routes corresponding to $D_1$, and $i_pi_q$ is a target route corresponding to $D_i$.

As described elsewhere in the present disclosure, the processing engine 112 may determine first traffic information indicating traffic that flows into the first region from the second boundary of the second region based on information (e.g., average speeds, first counts, first ratios) related to the one or more target routes. Taking two regions in Shenzhen as an example, the first region is the dashed polygon, and the second region is the dotted polygon. The second boundary of the dotted polygon includes Longhua heping Road from West to East, Qingquan Road from South to North, Dahe Road from South to North, Meilong Avenue from North to South, Qinghu Road from North to South, Guanlan Avenue from North to South, and Qingquan Road from North to South. A first ratio of vehicles flowing into the dashed polygon from Longhua heping Road from West to East is 16.15%. A first ratio of vehicles flowing into the dashed polygon from Qingquan Road from South to North is 14.72%. A first ratio of vehicles flowing into the dashed polygon from Dahe Road from South to North is 7.88%. A first ratio of vehicles flowing into the dashed polygon Meilong Avenue from North to South is 14.16%. A first ratio of vehicles flowing into the dashed polygon from Qinghu Road from North to South is 8.04%. A first ratio of vehicles flowing into the dashed polygon Guanlan Avenue from North to South is 16.63%. A first ratio of vehicles flowing into the dashed polygon from Qingquan Road from North to South is 16.07%.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and/or "some embodiments" mean that a particular feature, structure or characteristic described in connection with some embodiments is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer-readable media having computer readable program code embodied thereon.

A computer readable signal medium may include a propagated data signal with computer readable program code embodied therein, for example, in baseband or as part of a carrier wave. Such a propagated signal may take any of a variety of forms, including electro-magnetic, optical, or the like, or any suitable combination thereof. A computer readable signal medium may be any computer readable medium that is not a computer readable storage medium and that may communicate, propagate, or transport a program for use by or in connection with an instruction execution system, apparatus, or device. Program code embodied on a computer readable signal medium may be transmitted using any appropriate medium, including wireless, wireline, optical fiber cable, RF, or the like, or any suitable combination of the foregoing.

Computer program code for carrying out operations for aspects of the present disclosure may be written in any combination of one or more programming languages, including an object-oriented programming language such as Java, Scala, Smalltalk, Eiffel, JADE, Emerald, C++, C #, VB. NET, Python or the like, conventional procedural programming languages, such as the "C" programming language, Visual Basic, Fortran 2003, Perl, COBOL 2002, PHP, ABAP, dynamic programming languages such as Python, Ruby, and Groovy, or other programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Furthermore, the recited order of processing elements or sequences, or the use of numbers, letters, or other designations, therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software-only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claimed subject matter may lie in less than all features of a single foregoing disclosed embodiment.

We claim:

1. A system for determining traffic information of a region, comprising:

at least one storage medium including a set of instructions; and at least one processor in communication with the at least one storage medium, wherein when executing the set of instructions, the at least one processor is directed to:

determine a first region and a second region, the first region being within the second region;

obtain a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region;

obtain a plurality of driving routes of a plurality of vehicles in the first region and the second region in a predetermined time period;

select one or more driving routes that traverse the first boundary and the second boundary based on the set of links associated with the first region and the second region; and determine traffic information of the first region based on information related to the one or more selected driving routes, the traffic information including at least one of first traffic information indicating traffic flowing into the first region from the second region or second traffic information indicating traffic flowing out of the first region to the second region, wherein to determine the first traffic information, the at least one processor is directed to:

for each of the one or more selected driving routes that traverse the first boundary and the second boundary, determine a first link cross the first boundary;

determine a second link cross the second boundary;

determine a first location that the second link intersects with the second boundary;

determine a second location that the first link intersects with the first boundary; and determine a first average speed of vehicles traveling from the first location to the second location with respect to each of a plurality of target links forming the second boundary of the second region;

for each of the plurality of target links, determine a first count of vehicles entering the first region from each of the plurality of target links; and determine a first ratio associated with each of the plurality of target links based on the first count of vehicles and a total count of vehicles entering the first region from the plurality of target links; and determine the first traffic information based on at least one of the first average speeds, the first counts of vehicles, or the first ratios.

2. The system of claim 1, wherein to determine the second traffic information indicating traffic flowing out of the first region to the second region, the at least one processor is directed to cause the system to:

determine a third location that the first link intersects with the first boundary;

determine a fourth location that the second link intersects with the second boundary;

determine a second average speed of vehicles traveling from the third location to the fourth location with respect to each of the plurality of target links;

for each of the plurality of target links, determine a second count of vehicles leaving the first region via each of the plurality of target links; and determine a second ratio associated with each of the plurality of target links based on the second count of vehicles leaving the first region and a total count of vehicles leaving the first region via the plurality of target links; and determine the second traffic information based on at least one of the second average speeds, the second counts of vehicles, or the second ratios.

3. The system of claim 1, wherein the at least one processor is configured further to:

determine at least one congested driving route based on the traffic information of the first region.

4. The system of claim 1, wherein the at least one processor is configured further to:

transmit the traffic information associated with the first region and the second region to a third-party causing the third-party to adjust traffic lights control of at least the first region or the second region based on the traffic information associated with the first region and the second region.

5. The system of claim 1, wherein the at least one processor is configured further to:

transmit the traffic information associated with the first region and the second region to a third-party causing the third-party to perform traffic control on at least the first region or the second region.

6. A method implemented on a computing device having at least one processor, at least one storage medium, and a communication platform connected to a network, the method comprising:

determining a first region and a second region, the first region being within the second region;

obtaining a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region;

obtaining a plurality of driving routes of a plurality of vehicles in the first region and the second region in a predetermined time period;

selecting one or more driving routes that traverse the first boundary and the second boundary based on the set of links associated with the first region and the second region; and determining traffic information of the first region based on information related to the one or more selected driving routes, the traffic information including at least one of first traffic information indicating traffic flowing into the first region from the second region or second traffic information indicating traffic flowing out of the first region to the second region, wherein the determining the first traffic information includes:

for each of the one or more selected driving routes that traverse the first boundary and the second boundary, determining a first link cross the first boundary;

determining a second link cross the second boundary;

determining a first location that the second link intersects with the second boundary;

determining a second location that the first link intersects with the first boundary; and determining a first average speed of vehicles traveling from the first location to the second location with respect to each of a plurality of target links forming the second boundary of the second region;

for each of the plurality of target links, determining a first count of vehicles entering the first region from each of the plurality of target links; and determining a first ratio associated with each of the plurality of target links based on the first count of vehicles and a total count of vehicles entering the first region from the plurality of target links; and determining the first traffic information based on at least one of the first average speeds, the first counts of vehicles, or the first ratios.

7. The method of claim 6, wherein the determining the second traffic information indicating traffic flowing out of the first region to the second region includes:

determining a third location that the first link intersects with the first boundary;

determining a fourth location that the second link intersects with the second boundary;

determining a second average speed of vehicles traveling from the third location to the fourth location with respect to each of the plurality of target links;

for each of the plurality of target links, determining a second count of vehicles leaving the first region via each of the plurality of target links; and determining a second ratio based on the second count of vehicles leaving the first region and a total count of vehicles leaving the first region via each of the plurality of target links; and determining the second traffic information based on at least one of the second average speeds, the second counts of vehicles, or the second ratios.

8. The method of claim 6, further comprising:

determining at least one congested driving route based on the traffic information of the first region.

9. The method of claim 6, further comprising:

transmitting the traffic information associated with the first region and the second region to a third-party causing the third-party to adjust traffic lights control of at least the first region or the second region based on the traffic information associated with the first region and the second region.

10. The method of claim 6, further comprising:

transmitting the traffic information associated with the first region and the second region to a third-party causing the third-party to perform traffic control on at least the first region or the second region.

11. A non-transitory computer readable medium, comprising executable instructions that, when executed by at least one processor, directs the at least one processor to perform a method, the method comprising:

determining a first region and a second region, the first region being within the second region;

obtaining a set of links associated with the first region and the second region, the set of links including a plurality of first links inside the first region, a plurality of second links cross a first boundary of the first region, a plurality of third links inside the second region other than the first region, and a plurality of fourth links cross a second boundary of the second region;

obtaining a plurality of driving routes of a plurality of vehicles in the first region and the second region in a predetermined time period;

selecting one or more driving routes that traverse the first boundary and the second boundary based on the set of links associated with the first region and the second region; and determining traffic information of the first region based on information related to the one or more selected driving routes, the traffic information including at least one of first traffic information indicating traffic flowing into the first region from the second region or second traffic information indicating traffic flowing out of the first region to the second region, wherein the determining the first traffic information includes:

for each of the one or more selected driving routes that traverse the first boundary and the second boundary, determining a first link cross the first boundary;

determining a second link cross the second boundary;

determining a first location that the second link intersects with the second boundary;

determining a second location that the first link intersects with the first boundary; and determining a first average speed of vehicles traveling from the first location to the second location with respect to each of a plurality of target links forming the second boundary of the second region;

for each of the plurality of target links, determining a first count of vehicles entering the first region from each of the plurality of target links; and determining a first ratio associated with each of the plurality of target links based on the first count of vehicles and a total count of vehicles entering the first region from the plurality of target links; and determining the first traffic information based on at least one of the first average speeds, the first counts of vehicles, or the first ratios.

12. The non-transitory computer readable medium of claim 11, wherein the determining the second traffic information indicating traffic flowing out of the first region to the second region includes:

determining a third location that the first link intersects with the first boundary;

determining a fourth location that the second link intersects with the second boundary;

determining a second average speed of vehicles traveling from the third location to the fourth location with respect to each of the plurality of target links;

for each of the plurality of target links, determining a second count of vehicles leaving the first region via each of the plurality of target links; and determining a second ratio associated with each of the plurality of target links based on the second count of vehicles leaving the first region and a total count of vehicles leaving the first region via the plurality of target links; and determining the second traffic information based on at least one of the second average speeds, the second counts of vehicles, or the second ratios.

13. The non-transitory computer readable medium of claim 11, the method further comprising:

determining at least one congested driving route based on the traffic information of the first region.

14. The non-transitory computer readable medium of claim 11, the method further comprising:

transmitting the traffic information associated with the first region and the second region to a third-party causing the third-party to adjust traffic lights control of at least the first region or the second region based on the traffic information associated with the first region and the second region.

15. The non-transitory computer readable medium of claim 11, the method further comprising:

transmitting the traffic information associated with the first region and the second region to a third-party causing the third-party to perform traffic control on at least the first region or the second region.

* * * * *